US011597586B2

(12) United States Patent
Kümpel et al.

(10) Patent No.: US 11,597,586 B2
(45) Date of Patent: Mar. 7, 2023

(54) CONTAINER FOR CONSUMER GOODS

(71) Applicant: JT International S.A., Geneva (CH)

(72) Inventors: Jürgen Kümpel, Konz (DE); Laura Grau, Hingen (DE)

(73) Assignee: JT International S.A.

( * ) Notice: Subject to any disclaimer, the term of this patent is extended or adjusted under 35 U.S.C. 154(b) by 0 days.

(21) Appl. No.: 17/417,836

(22) PCT Filed: Mar. 27, 2020

(86) PCT No.: PCT/EP2020/058781
§ 371 (c)(1),
(2) Date: Jun. 24, 2021

(87) PCT Pub. No.: WO2020/201123
PCT Pub. Date: Oct. 8, 2020

(65) Prior Publication Data

US 2022/0081191 A1 Mar. 17, 2022

(30) Foreign Application Priority Data

Mar. 29, 2019 (EP) ..... 19166279

(51) Int. Cl.
*B65D 85/10* (2006.01)

(52) U.S. Cl.
CPC ..... *B65D 85/1036* (2013.01)

(58) Field of Classification Search
CPC .... B65D 65/14; B65D 85/10; B65D 85/1036; B65D 85/1045; B65D 85/10568
(Continued)

(56) References Cited

U.S. PATENT DOCUMENTS 8,783,454 B2 * 7/2014 Igo ..... B65D 85/1045 229/117.34
10,081,484 B2 * 9/2018 Pilzecker ..... B65D 85/1018
(Continued)

FOREIGN PATENT DOCUMENTS

CN 1738746 A 2/2006
CN 106275886 A * 1/2017 ..... B65D 85/10
(Continued)

OTHER PUBLICATIONS

International Search Report for Application No. PCT/EP2020/058781 dated May 25, 2020, pp. 1-5.
(Continued)

*Primary Examiner* — Bryon P Gehman
(74) *Attorney, Agent, or Firm* — Lerner, David, Littenberg, Krumholz & Mentlik, LLP

(57) ABSTRACT

A container for consumer goods includes an outer housing; and an inner liner for storing consumer goods, wherein the inner liner is arranged within the outer housing; and the outer housing includes a closing flap for opening and closing the container, wherein the closing flap is integral with the outer housing and includes a top panel and a front panel; and the inner liner includes an opening for allowing access to the consumer goods within the inner liner in an open configuration of the container, the opening being closed by a reclosable inner liner flap in a closed configuration of the container, wherein the inner liner flap is attached to the inner liner at least partially by a re-sealable adhesive; and wherein the closing flap is permanently attached to the inner liner flap.

16 Claims, 7 Drawing Sheets

Figure 1:
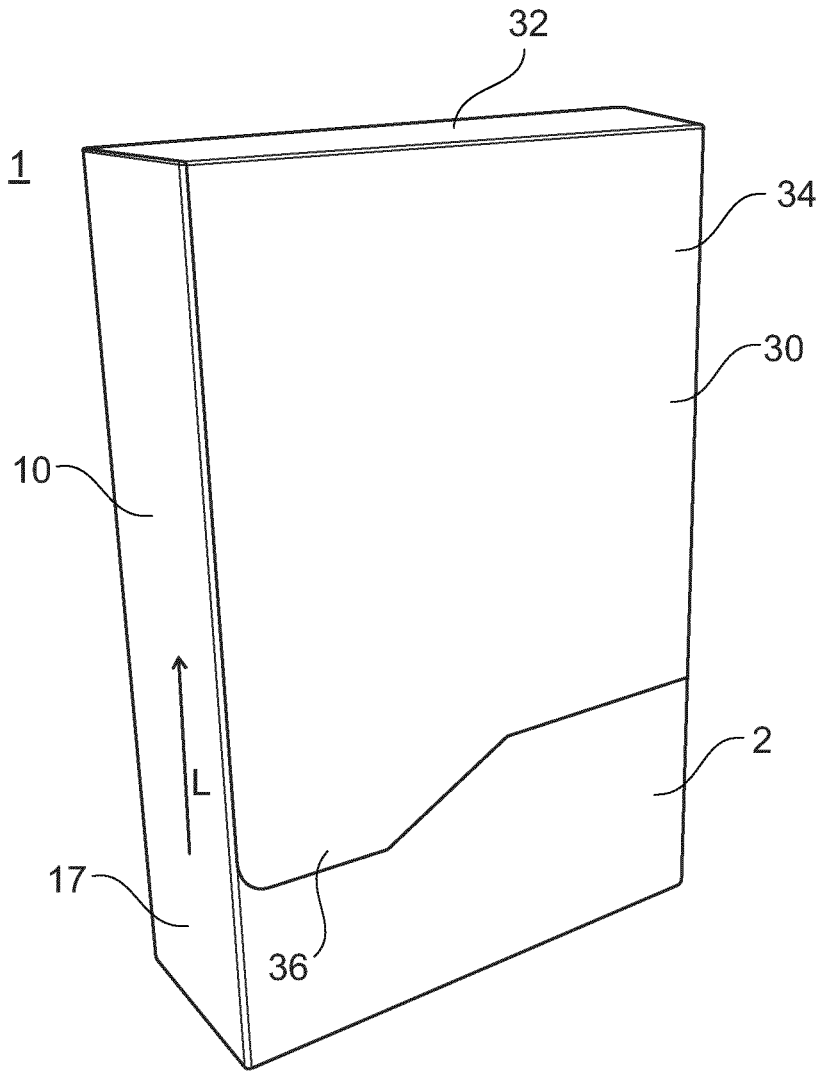

(58) Field of Classification Search
USPC ..... 206/264, 268
See application file for complete search history.

(56) References Cited

U.S. PATENT DOCUMENTS

| | | | |
|---|---|---|---|
| 2005/0236283 | A1 | 10/2005 | Ito |
| 2011/0068155 | A1 | 3/2011 | Yoshimura et al. |
| 2016/0096678 | A1 | 4/2016 | Tacchi et al. |
| 2017/0327304 | A1 | 11/2017 | Chatelain |

FOREIGN PATENT DOCUMENTS

| | | | | | |
|---|---|---|---|---|---|
| CN | 206125913 | U | * | 4/2017 | ..... B65D 85/10 |
| CN | 107000923 | A | | 8/2017 | |
| EP | 1595807 | A1 | | 11/2005 | |
| RU | 2474524 | C2 | | 2/2013 | |
| RU | 2715790 | C1 | | 3/2020 | |
| WO | 2013046444 | A1 | | 4/2013 | |
| WO | 2014188357 | A1 | | 11/2014 | |
| WO | 2016097298 | A1 | | 6/2016 | |
| WO | 2018134593 | A1 | | 7/2018 | |
| WO | 2018189075 | A1 | | 10/2018 | |

OTHER PUBLICATIONS

Search Report dated Jul. 13, 2022 from the Office Action for Chinese Application No. 202080015490.6 issued Jul. 19, 2022, pp. 1-3.

* cited by examiner

CONTAINER FOR CONSUMER GOODS

CROSS-REFERENCE TO RELATED APPLICATIONS

The present application is a national phase entry under 35 U.S.C. § 371 of International Application No. PCT/EP2020/058781, filed Mar. 27, 2020, published in English, which claims priority to European Application No. 19166279.0 filed Mar. 29, 2019, the disclosures of which are incorporated herein by reference.

1. TECHNICAL FIELD

The present invention relates to a container for consumer goods. The container is particularly suitable for storing tobacco articles, like cigarettes.

2. PRIOR ART

Fragile goods, like for instance cigarettes, are usually packaged and brought into market in small containers in order to protect the goods during transport. Such containers can be made of renewable raw material like paperboard and often comprise a plurality of components. Usually, a softer, odorless and unflavored inner liner directly stores the consumer goods, while a harder outer housing forms the container and protects the goods against environmental conditions and impacts from the outside. In some cases, the outer housing comprises a hinged three-dimensional lid for closing and opening of the container. The container additionally is wrapped in a transparent plastic foil for further protection and as integrity seal. The document WO 2018/134593 A1 shows such a cigarette pack with a three-dimensional lid.

Apart from containers for cigarettes that have a hinged three-dimensional lid other kinds of containers for cigarettes are known, that have a closing flap of a flat piece of material for covering an opening of a box portion of the container:

The document WO 2016/097298 A1 discloses a container for cigarettes which comprises a box having an opening therein for accessing the cigarettes in the package, in which the opening extends across the top wall from the front edge thereof and wherein the periphery of the access opening is spaced apart from the rear edge and the side edges of the top wall so that the top wall extends around the rear and sides of the opening. A closure flap is moveable between a closed position in which the flap covers the opening and an open position in which the opening is uncovered extends from the rear wall of the package.

The document WO 2014/188357 A1 discloses a container for cigarettes, comprising a group of articles, a sealed package enclosing the group of articles and having a first cover flap, which is defined by a first cut through the sealed package and is movable to allow access to the group of articles, a rigid container enclosing the sealed package and having a second cover flap, which is defined by a second cut through the container, and which is superimposed on the first cover flap of the sealed package and is movable to allow access to the sealed package, and a re-closable adhesive panel, which is coated on the inside with re-stick adhesive, and has a grip tab with no re-stick adhesive and which is located at an edge of the adhesive panel. The second cover flap is superimposed directly on the first cover flap, and is glued permanently to the first cover flap, and the adhesive panel is located outside the container, is larger than the second cover flap, is superimposed on the second cover flap, is glued permanently to the second cover flap, and is glued releasably by the first re-stick adhesive to a portion of the container surrounding the second cover flap.

Such prior art containers for cigarettes, have the disadvantage that extraction of the first cigarette from the front through very small opening may be difficult. Further, the prior art constructions require complex blanks for the outer housing or a closure flap that is provided in addition to the outer housing. Additionally, the prior art containers may require a re-sealable adhesive applied to the outer housing which may cause manufacturing problems and re-closing problems during repeated use.

It is therefore the object of the present invention to provide a container for consumer goods and a corresponding inner liner, that overcomes the drawbacks of the above mentioned containers.

3. SUMMARY OF THE INVENTION

The above-mentioned problem is solved by a container for consumer goods according to claim 1.

The above mentioned problems are solved by a container for consumer goods comprising an outer housing, and an inner liner for storing consumer goods, wherein the inner liner is arranged within the outer housing, and the outer housing comprising a closing flap for opening and closing the container, wherein the closing flap is integral with the outer housing and comprises a top panel and a front panel, and the inner liner comprises an opening for allowing access to the consumer goods within the inner liner in an open configuration of the container, said opening being closed by a re-closable inner liner flap in a closed configuration of the container, wherein the inner liner flap is attached to the inner liner at least partially by a re-sealable adhesive, and wherein the closing flap is permanently attached to the re-closable inner liner flap.

Such a container has the advantage that for the closing flap no additional element is needed as it is integral with the outer housing. This minimizes handling and assembly effort and manufacturing costs. Further, due to the re-closable inner liner flap the inner liner can be re-sealably closed for sealing the consumer goods within the inner liner. This maintains the quality of the consumer goods and prevents any undesired release of tobacco particles out of the closed container. Further, the re-sealability is maintained for a large number of opening and closing steps since the re-sealable adhesive seals in-between the inner liner flap and the inner liner, which are usually made of a foil-like material that provides good adhesion properties. Thereby, no re-sealable adhesive is required at the closing flap itself. Thus, the container including the closing flap can have a structured or rough surface quality that is not suitable as contact surface of a re-sealable adhesive.

Preferably, the opening in the inner liner extends at least partially to a front panel thereof, and the opening is accessible through a cutout in a front panel of the outer housing for facilitating access to the consumer goods in the open configuration of the container. Thus, a comparably large re-sealable opening of the inner liner is provided that allows a convenient access to the consumer goods.

Preferably, the cutout in the front panel has a length He measured in a longitudinal direction of the outer housing that is at least 50% of the length of the container in said longitudinal direction L, preferably 60-70% of the length of the container. Thus, the cutout provides on the one hand a large opening for a convenient access to the consumer goods, and on the other hand a large area, where the inner liner is exposed and provides an area for re-sealable adhesive for attaching with the inner liner flap.

Preferably, the cutout in the front panel of the outer housing reveals at least a portion at the front panel of the inner liner arranged between the opening of the inner liner and at least a side of the cutout in the longitudinal direction. At least this portion at the front panel of the inner liner can be used as adhering face for the re-sealable adhesive.

Preferably, the cutout in the front panel of the outer housing reveals portions at the front panel of the inner liner arranged between the opening of the inner liner and at least three sides of the cutout. Thus, three sides at the front panel of the inner liner which are surrounding the opening of the inner liner can be used as adhering face for the re-sealable adhesive.

Preferably, the inner liner flap comprises a front panel, which is located within the boundaries of the cutout of the front panel of the outer housing in the closed configuration of the container. Thus, the inner liner flap contacts the inner liner only, what improves adhering by the re-sealable adhesive. This improves sealing the inner liner, what improves maintaining the quality of the consumer goods.

Preferably, the re-closable inner liner flap adheres to the revealed portion at the front panel of the inner liner by the re-sealable adhesive in the closed configuration of the container.

Preferably, in the closed configuration of the container, the closing flap is re-sealably adhered to the front of the container by means of the re-sealable adhesive between the re-closable inner liner flap and inner liner, only. Thus, the re-sealable adhesive between the re-closable inner liner flap and inner liner provides exclusively for the adhesion for the closing of the container and there is no re-sealable adhesive necessary between the closing flap and a front panel of the outer housing.

Preferably, the re-sealable adhesive is part of the inner liner flap.

Preferably, the re-sealable adhesive is part of the inner liner. The re-sealable adhesive can be applied to be part of the inner liner flap or part of the inner liner. The respective counterpart provides an adhesion face where the re-sealable adhesive can adhere well.

Preferably, a box portion of the outer housing comprises a fully open top side arranged below the top panel of the closing flap in the closed configuration of the container. This allows to use a simplified outer housing which safes material and production effort.

Preferably, the inner liner is movable within the outer housing partially out of the fully open top side. This movement enables a full opening of the container by opening the closing flap without deforming the top panel of the closing flap. This improves the appearance of the top panel of the closing flap and enables an improved re-sealing of the opening of the inner liner by means of the inner liner flap permanently attached to the closing flap.

Preferably, the outer housing comprises tabs that are permanently adhered to a bottom panel of the inner liner and are pivotally arranged within the outer housing. These tabs on the on hand secure the inner liner within the outer housing but allow on the other hand a movement of the inner liner within the outer housing along the longitudinal direction L.

Preferably, the closing flap comprises a gripping tab at the lower edge of the front panel of the closing flap. The gripping tab enables the user to easily grab the closing flap in closed configuration of the container for opening the closing flap. Preferably the closing flap is not covered by the inner liner flap and is free of any re-sealable adhesive.

Preferably, the front panel of the closing flap has a length Hf measured in longitudinal direction L of the container that is larger than the length He of the cutout in the front panel of the outer housing. Thus, the closing flap preferably covers the complete cutout in the front panel in closed configuration of the container.

Preferably the container further comprises an inner frame arranged within the inner liner. This inner frame improves rigidity of the container, preferably in the area around the cutout in the outer housing.

4. SHORT DESCRIPTION OF THE DRAWINGS

Figure 2:
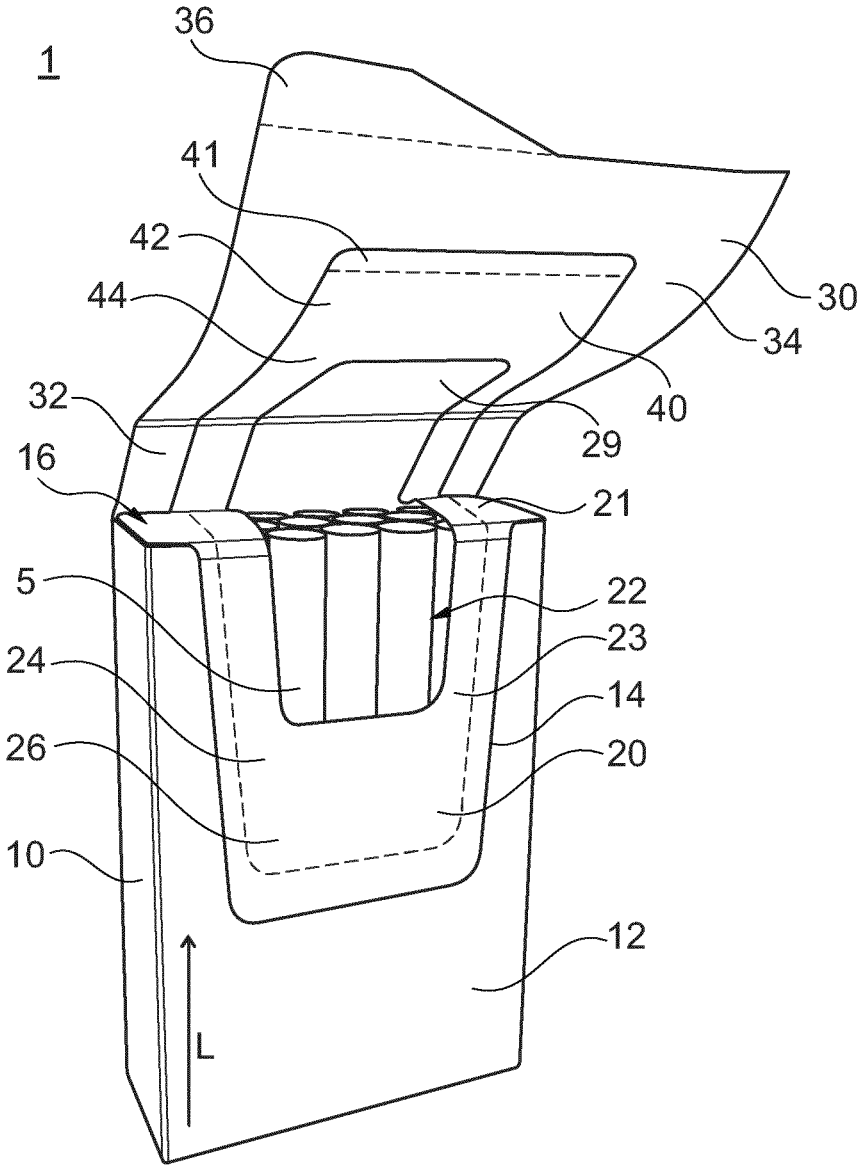
Figure 3:
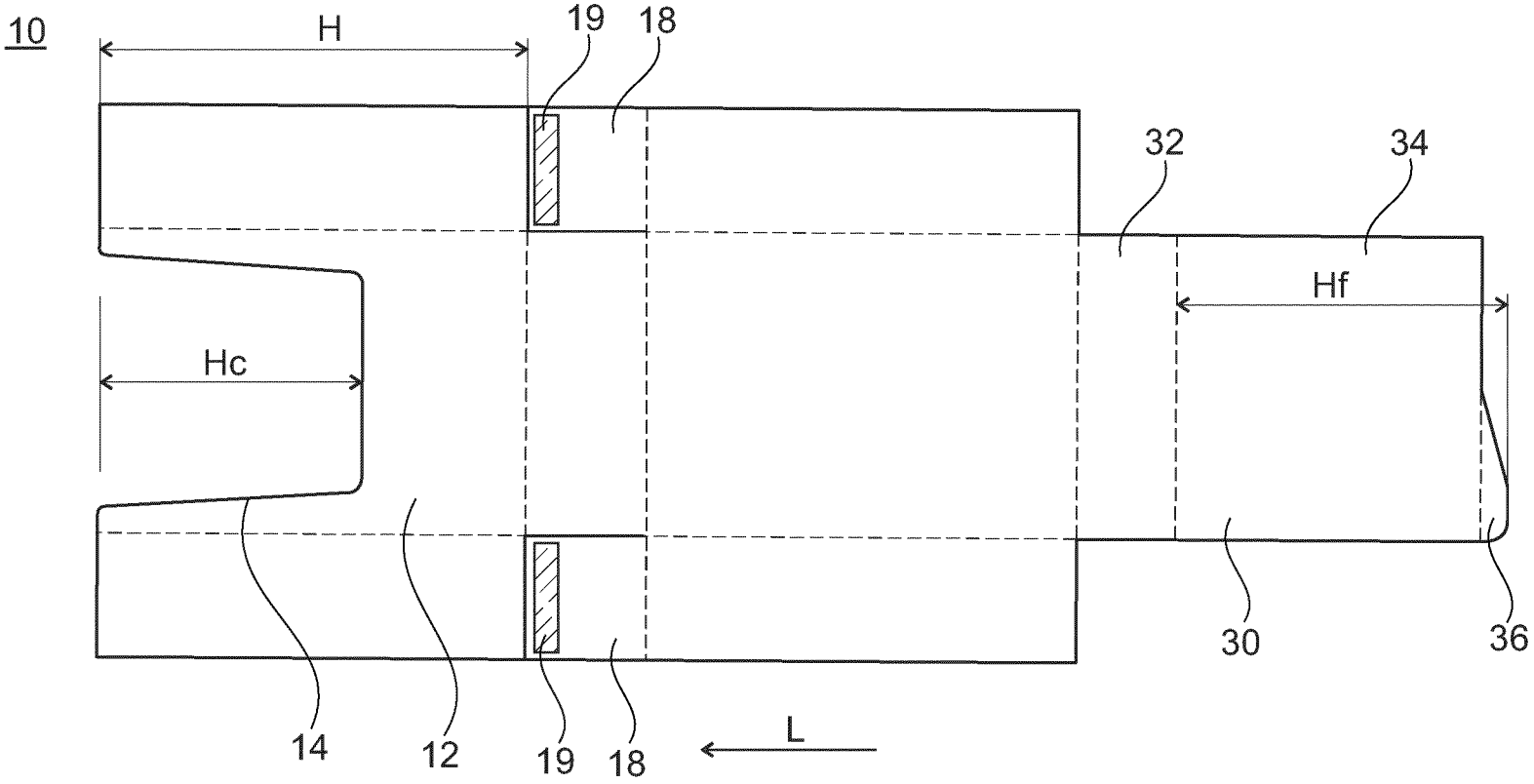
Figure 4:
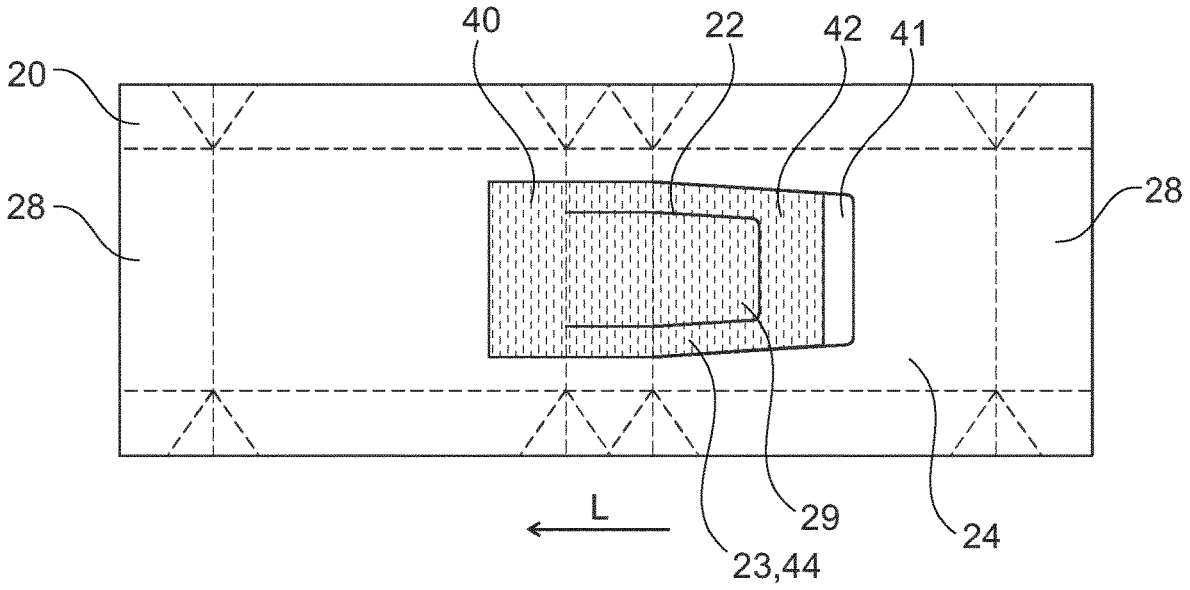
Figure 5:
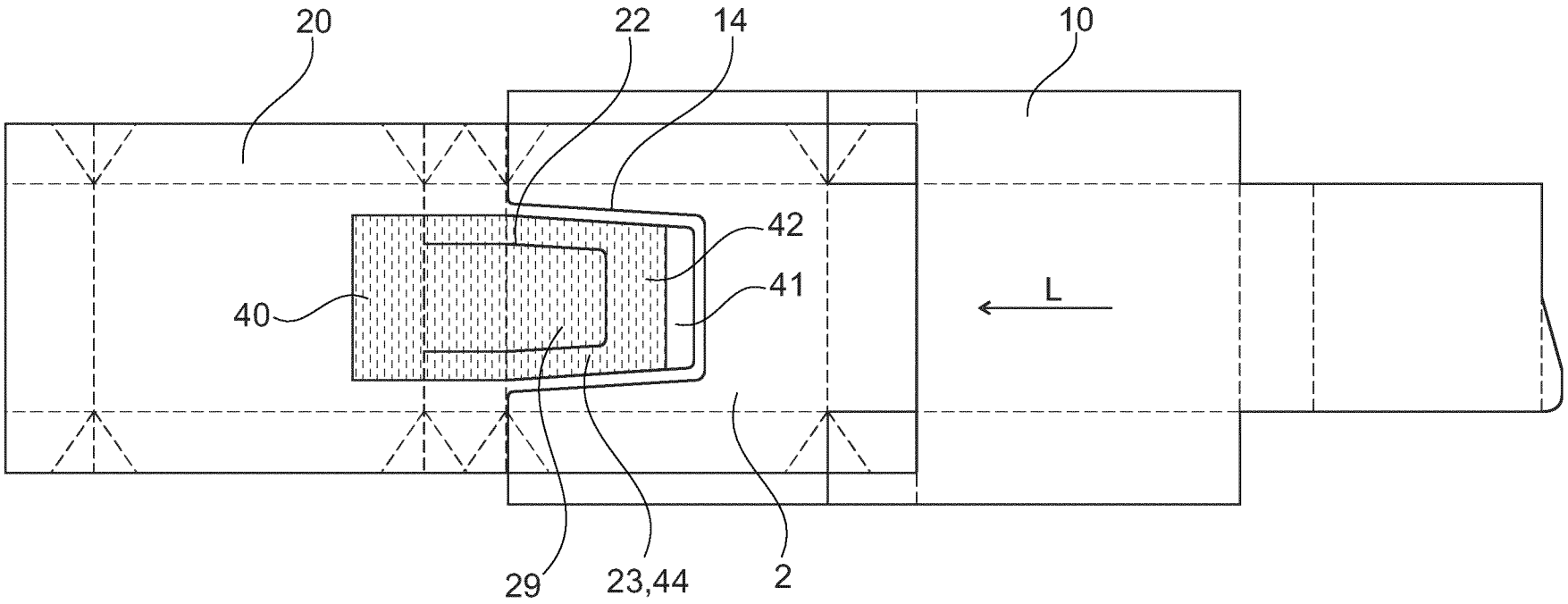
Figure 6:
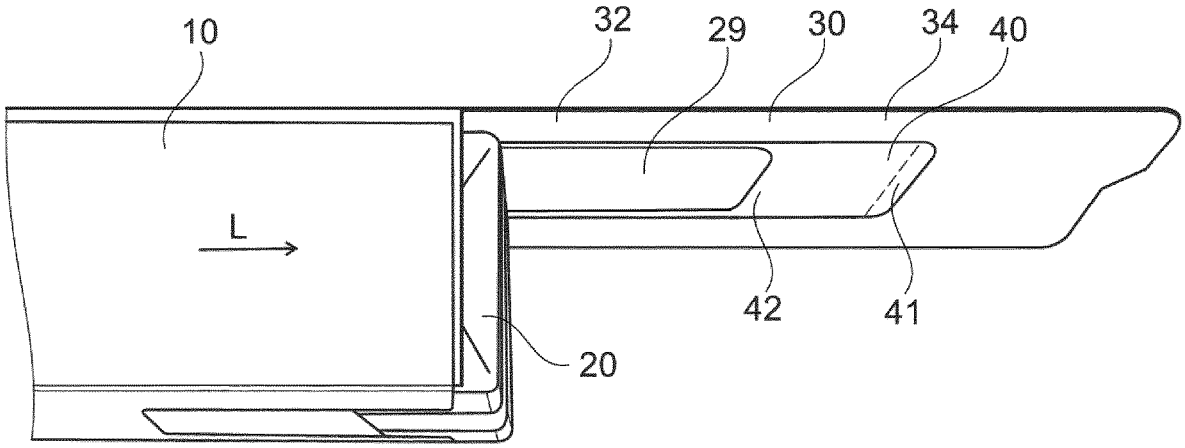
Figure 7:
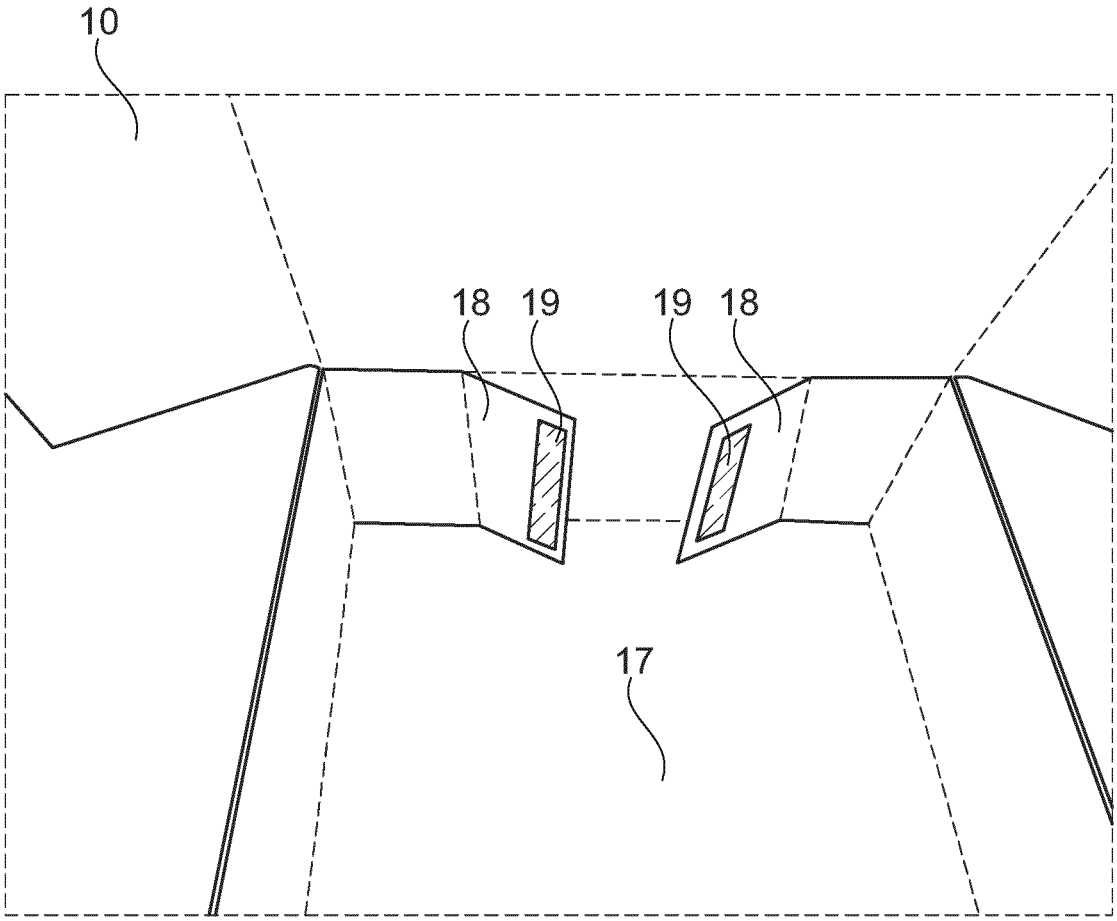

In the following, preferred embodiments of the invention are disclosed by reference to the accompanying figures, in which shows:

FIG. 1: a three-dimensional view of a preferred embodiment of a container in closed configuration;

FIG. 2: a three-dimensional view of the preferred embodiment of a container of FIG. 1 in opened configuration;

FIG. 3: a two-dimensional view of a blank of the outer housing of the container of FIG. 1;

FIG. 4: a two-dimensional view of blanks of the inner liner and the inner liner flap of the container of FIG. 1;

FIG. 5: a two-dimensional view of blanks of the outer housing, the inner liner and the inner liner flap of the container of FIG. 1, showing the respective geometric arrangement in the area of the front panels;

FIG. 6: a three-dimensional side view of a top part of the container of FIG. 1 in open configuration; and FIG. 7: a three-dimensional view from a lower inner area of the outer housing of the container of FIG. 1 during manufacturing.

5. DESCRIPTION OF PREFERRED EMBODIMENTS

In the following preferred embodiments of the invention are described with respect to the figures.

FIGS. 1 and 2 shows an embodiment of a container 1 for consumer goods 5, for example cigarettes 5. FIG. 1 shows the container 1 in closed configuration and FIG. 2 shows the container 1 in open configuration. The size of the container 1 comprises a height of about 70 to 120 mm and a width of about 40 to 72 mm and a thickness of about 16 to 25.5 mm. These dimensional ranges for the container are given here purely as examples and shall not be construed as limitative of the scope of the present invention as such. Other dimensions shall be contemplated by the skilled person depending on the kind of consumer goods to be packaged in the container 1.

The container 1 has a generally cuboid shape. The container 1 can, for sale, be wrapped with a transparent plastic foil (not shown) as integrity seal and for further protection of the consumer goods during shipping.

The container 1 comprises an outer housing 10 with a box portion 12 and a closing flap for opening and closing the container 1. The outer housing 10 is preferably made from cardboard or stiff paper material of more than 120 g/m$^2$. The closing flap 30 is integral with the outer housing 10 and consists of a top panel 32 and a front panel 34. The front panel 34 comprises at a lower end thereof a gripping tab 36, for gripping the front panel 34 in closed configuration of the container 1. The top panel 32 and the front panel 34 are essentially flat panels of the cardboard or stiff paper material of the outer housing 10. By this essential flat shape of the panels 32, 34 of the closing flap 30 the closing flap 34 has a different configuration than hinged three-dimensional lids of prior art cigarette containers.

The closing flap 30 is hingedly attached to the box portion 17 at the back side of the container 1 and can be brought manually from a closed position as shown in FIG. 1 into an open position, as shown in FIG. 2. Thereby, the hinge of the closing flap 30 is made of a fold of the paper or cardboard of the outer housing 10 and can be easily manufactured. In the closed position the consumer goods 5 are fully protected inside the container 1, wherein in the open position access to the consumer goods 5 is given and for example one or several of said consumer goods, in the represented example, smoking articles such as cigarettes or like, can be taken out from the container 1.

The container 1 further comprises an inner liner 20 for storing the consumer goods 5. The inner liner 20 is made of a metallized paper or plastic foil material and is tightly wrapped around a number of consumer goods 5. The inner liner 20 and consumer goods 5 tightly packed therein from a generally cuboid charge that is arranged within the outer housing 10.

The inner liner 20 comprises an opening 22 for allowing access to the consumer goods 5 when the container 1 is in open configuration. The opening 22 is preferably cut out from the inner liner 20 blank and extends along the top panel 21 and the front panel 24 of the inner liner 20 for facilitating easy removal of consumer goods 5. Said opening 22 can be closed by a re-closable inner liner flap 40 when the container 1 is in closed configuration. In this closed condition the inner liner flap 40 is attached to the inner liner 20 at least partially by a re-sealable adhesive 42 (see FIG. 4). This re-sealable adhesive 42 is preferably permanently attached to a portion of the inner side of the inner liner flap 40 such that it re-sealably adheres to a boundary area 23 of the inner liner 20 around the opening 22. This ensures an almost air-tight sealing of the inner liner 20 even after a number of manual opening and closing operations.

As shown in FIG. 4, the inner liner flap 40 is preferably provided in form of a sticker that is attached to the blank of the inner liner 20 by the re-sealable adhesive 42 prior to wrapping the inner liner 20 around the consumer goods 5. In this way the inner liner flap 40 also adheres permanently to the outer side of an inner liner tongue 29 which is cut out at the front and top panel of the inner liner 20 when the opening 22 is cut out by a U-shaped cut. This inner liner tongue 29 will move together with the inner liner flap 40.

The inner liner flap 40 is further permanently attached by its outer side to an inner side of the closing flap 30. For this attachment a permanent adhesive can be used. Thus, by moving the closing flap 30 the inner liner flap 40 will move as well. If the user wants to open the container 1 and moves the closing flap 30 from the closed to the open position, the bond of the re-sealable adhesive 42 between the outer side of the inner liner 20 and the inner side of the inner liner flap 40 is released and the opening 22 is exposed for allowing removal of consumer goods 5. If the user wants to close the container 1 and moves the closing flap 30 from the open to the closed position, the bond of the re-sealable adhesive 42 is made again and the opening 22 is closed for securing the consumer goods 5 inside the container 1 and maintaining their quality.

FIG. 3 shows a two-dimensional view of a blank of the outer housing 10. In FIGS. 3-5 cuts are shown by integral lines and crease or fold lines are shown by dashed lines. The length He of the cutout 14 in the front panel 12 measured in longitudinal direction L is at least 50% of the length H of the container 1 in this longitudinal direction L. Preferably, the length He of the cutout 14 is 60-70% of the length H of the container. The length Hf in longitudinal direction L of the front panel 34 of the closing flap 30 is longer than the length Hc, such that the cutout 14 is fully covered by the front panel 34.

FIG. 4 shows a two-dimensional view of blanks of the inner liner 20 and the inner liner flap 40 of the container of FIG. 1. As shown, the inner liner flap 40 comprises an area at the underside thereof that is covered with re-sealable adhesive 42. This area with re-sealable adhesive 42 fully covers the cutout of the opening 22 and spans over the inner liner tongue 29 and the boundary area 23 around the opening 22. Further, the inner liner flap 40 comprises an area 41 that is free of re-sealable adhesive 42. The upper side of the inner liner flap 40 is at least partially attached to the closing flap 30 preferably by a permanent adhesive.

As shown in FIG. 4, the inner liner flap 40 is larger than the opening 22 in all directions. This includes any panel of the inner liner 20 across which the opening 22 extends. Preferably, the inner liner flap 40 is a few millimeters larger than the opening 22 in all directions. Preferably, the inner liner flap 40 is at least about 0.2 mm larger than the opening 22, preferably, at least about 0.5 mm larger, or at least 1 mm or at least 2 mm larger.

FIG. 5 shows a two-dimensional view of blanks of the outer housing 10, the inner liner 20, and the inner liner flap 40 of container 1. FIG. 1 shows the respective geometric arrangement of these elements 10, 20, 30 in the area of the respective front panels. As shown, the inner liner flap 40 is adhered to the inner liner 20 such that its front panel 42 is arranged completely within the cutout 14 of the outer housing 10. This ensures that the inner liner flap 40 adheres by the re-sealable adhesive 42 only to the outer side of the inner liner 20 and not to the outer housing 10. This provides for a good adherence of the inner liner flap 40 and an almost air-tight sealing of the inner liner 20. Further, it does not require a precise positioning by the customer. In the boundary area 23 around the opening 22 the re-sealable adhesive 42 can be attached and released several times without substantially diminishing the adhesion bond. On the other hand, the area 41 that is free of re-sealable adhesive 42 allows for an easy opening of the closing flap 30 inner liner flap 40 combination.

Thus, in the preferred embodiment, the front panel 44 of the inner liner flap 40 is larger than the extension of the opening 22 across the front panel 24 of the inner liner 20, but smaller than the cutout 14 of the front panel 12 of the outer housing 10. As a result, in the closed configuration of the container 1, the inner liner flap 40 covers the opening 22 while adhering to the inner liner 20 and not to the outer housing 10 without requiring a precise positioning by the consumer. Preferably, the front panel 44 of the inner liner flap 40 is a few millimeters smaller than the cutout 14 in the front panel 12 of the housing 10, preferably about 0.2 mm smaller in all directions.

FIG. 6 shows a three-dimensional side view of a top part of the container 1 of FIG. 1 in open configuration. It is shown that the charge of consumer goods wrapped in the inner liner 20 is able to move in longitudinal direction L of the container 1 within the outer housing 10. This longitudinal movement of the charge received in the outer housing is advantageously allowed by pivotally arranged connection tabs on the innermost bottom side of the outer housing, as shown in FIG. 7 and described hereinafter.

FIG. 7 shows a three-dimensional view from a lower inner area of the outer housing 10 of the container of FIG. 1 without the charge of consumer goods 5 and inner liner 20 received therein. Thus, the box portion of the outer housing 10 is not completely folded, for improving visibility. For providing the longitudinal movement of the charge of consumer goods as shown in FIG. 6 lower tabs 18 of the outer housing 10 are pivotally arranged within the outer housing 10 and permanently adhered to the bottom panel 28 (see FIG. 4) of the inner liner 20 by permanent adhesive 19. Thus, the inner liner package 20 is on the one hand able to move a certain distance within the outer housing 10, but is on the other hand securely held within the container 1. This particular construction of the outer housing on its inner bottom side and permanent, yet movable, linkage of the inner liner 20 to the pivotable connection tabs 18 prevents that the combination of inner liner tongue 29, inner liner flap 40 and closing flap 30 is bent or otherwise deformed during opening of the container 1.

LIST OF REFERENCE SIGNS

1 container
2 front of container
5 consumer goods, cigarettes
10 outer housing
12 front panel of outer housing
14 cutout of outer housing
16 fully open to side of outer housing
17 box portion
18 tabs
19 permanent adhesive
20 inner liner
21 top panel of inner liner
22 opening of inner liner
23 boundary area of inner liner
24 front panel of inner liner
26 revealed portion at front panel of inner liner
28 bottom panel of inner liner
29 inner liner tongue
30 closing flap
32 top panel of closing flap
34 front panel of closing flap
36 gripping tab of closing flap
40 inner liner flap
41 area free of re-sealable adhesive
42 re-sealable adhesive
44 front panel
L longitudinal direction
H length of container 1
He length of cutout 14
Hf length of front panel 34

The invention claimed is:

1. A container for consumer goods comprising:

a. an outer housing; and b. an inner liner for storing consumer goods, wherein the inner liner is arranged within the outer housing; and c. the outer housing comprising a closing flap for opening and closing the container, wherein the closing flap is integral with the outer housing and comprises a top panel and a front panel; and d. the inner liner comprises an opening for allowing access to the consumer goods within the inner liner in an open configuration of the container, said opening being closed by a reclosable inner liner flap in a closed configuration of the container, wherein the reclosable inner liner flap is attached to the inner liner at least partially by a re-sealable adhesive; and wherein e. the closing flap is permanently attached to the reclosable inner liner flap.

2. The container according to claim 1, wherein the opening in the inner liner extends at least partially to a front panel thereof, and the opening is accessible through a cutout in a front panel of the outer housing for facilitating access to the consumer goods in the open configuration of the container.

3. The container according to claim 2, wherein the cutout in the front panel of the outer housing has a length measured in a longitudinal direction of the outer housing that is at least 50% of a length of the container in said longitudinal direction.

4. The container according to claim 2, wherein the cutout in the front panel of the outer housing reveals at least a portion at the front panel of the inner liner arranged between the opening of the inner liner and at least a side of the cutout in a longitudinal direction of the outer housing.

5. The container according to claim 2, wherein the reclosable inner liner flap comprises a front panel, which is located within boundaries of the cutout of the front panel of the outer housing in the closed configuration of the container.

6. The container according to claim 5, wherein the reclosable inner liner flap adheres to the revealed portion at the front panel of the inner liner by the re-sealable adhesive in the closed configuration of the container.

7. The container according to claim 2, wherein the front panel of the closing flap has a length measured in a longitudinal direction of the container that is larger than a length of the cutout in the front panel of the outer housing.

8. The container according to claim 2, wherein the cutout in the front panel of the outer housing has a length measured in a longitudinal direction of the outer housing that is 60-70% of a length of the container in said longitudinal direction.

9. The container according to claim 1, wherein, in the closed configuration of the container, the closing flap is re-sealably adhered to a front of the container by the re-sealable adhesive between the reclosable inner liner flap and inner liner, only.

10. The container according to claim 1, wherein the re-sealable adhesive is part of the reclosable inner liner flap.

11. The container according to claim 1, wherein the re-sealable adhesive is part of the inner liner.

12. The container according to claim 1, wherein a box portion of the outer housing comprises a fully open top side arranged below the top panel of the closing flap in the closed configuration of the container.

13. The container according to claim 12, wherein the inner liner is movable within the outer housing partially out of the fully open top side.

14. The container according to claim 12, wherein the outer housing comprises tabs that are permanently adhered to a bottom panel of the inner liner and are pivotally arranged within the outer housing.

15. The container according to claim 1, wherein the closing flap comprises a gripping tab at a lower edge of the front panel of the closing flap.

16. The container according to claim 1, further comprising an inner frame arranged within the inner liner.

* * * * *